US007169946B1

(12) United States Patent
Thode

(10) Patent No.: US 7,169,946 B1
(45) Date of Patent: Jan. 30, 2007

(54) ALTERNATIVES TO DISTILLED OLEO CHEMICALS IN DERIVATIVES AND PRODUCTION THEREOF

(75) Inventor: Kenneth C. Thode, Sunset Beach, NC (US)

(73) Assignee: Twin Rivers Technologies, L.P., Quincy, MA (US)

( * ) Notice: Subject to any disclaimer, the term of this patent is extended or adjusted under 35 U.S.C. 154(b) by 0 days.

(21) Appl. No.: 11/071,131

(22) Filed: Mar. 2, 2005

Related U.S. Application Data

(60) Provisional application No. 60/550,786, filed on Mar. 5, 2004.

(51) Int. Cl.
*C11B 3/00* (2006.01)

(52) U.S. Cl. ..... 554/191

(58) Field of Classification Search ..... 554/191
See application file for complete search history.

(56) References Cited

U.S. PATENT DOCUMENTS 4,655,879 A 4/1987 Brockmann et al. ..... 203/37
4,857,237 A 8/1989 Kopp et al. ..... 554/147
5,225,049 A * 7/1993 Barmentlo et al. ..... 554/191
5,723,673 A 3/1998 Kao et al. ..... 564/487

FOREIGN PATENT DOCUMENTS

WO 01-83655 * 11/2001
WO WO 01/83655 A1 11/2001

OTHER PUBLICATIONS

Chem. Abstr., Irodov et al., "Preparation of light fatty Acid,", Maslozhirovaya Promyshiennost, 35(9), pp. 16-17, 1969.*
Calgon Carbon Corp., "CPG® LF 12×40, Acid Washed Granular Activated Carbon" (2003).
Procter & Gable Chemicals, "BSE_May_2003" (May 21, 2003) <http://www.pgchemicals.com/content/pdf/certifications/glycerine/BSE_May_2003.pdf>.

* cited by examiner

*Primary Examiner*—Deborah D. Carr
(74) *Attorney, Agent, or Firm*—Mintz, Levin, Cohn, Ferris, Glovsky and Popeo, P.C.

(57) ABSTRACT

As a substitute for distillation of crude feedstock in the production of oleo-chemicals, the crude feedstock is bleached to remove color and odor. The crude feedstock can include fatty acids and/or glycerin, and the bleached product can be incorporated into a commercial product, such as liquid laundry detergent, bar soap, anti-freeze, paper de-inking cleaners, lubricants, dark rubber and plastics.

11 Claims, 3 Drawing Sheets

ALTERNATIVES TO DISTILLED OLEO CHEMICALS IN DERIVATIVES AND PRODUCTION THEREOF

RELATED APPLICATION

This application claims the benefit of U.S. Provisional Application No. 60/550,786, filed Mar. 5, 2004, the entire teachings of which are incorporated herein by reference.

BACKGROUND

Most commercial fatty acids and glycerin are produced from natural fats, oils, and greases, including tall oil, vegetable oils and animal tallow. These fats, oils and greases jointly referred to as "natural oils") comprise a mixture of mono-, di-, and tri-glyceride molecules, natural contaminants, and free fatty acids. While different natural oils include many chemically similar molecules, the natural oils vary in quality and each may be distinguished by its characteristic color, odor, chemical composition, and hydrocarbon chain length distribution, each of which is similar to that of the source of the oil. For example, sunflower oil is yellow; coconut oil has a sweet odor; and soybean oil is concentrated in long hydrocarbon chain lengths.

Some end-product applications require a quality in the natural oil that can only be achieved when processed from improved-quality feedstocks. A feedstock of "improved quality" will generally have reduced color and reduced odor compared with the raw feedstock; and some contaminants, including the naturally occurring free fatty acid, may have been reduced. The improved quality can be achieved by refining, bleaching and deodorizing; suitable processes include treating the oil with agents to coagulate gums in the oil and adsorption bleaching, wherein the oil interacts with a mixture of one or more adsorption agents, such as bleaching clay, activated carbon, and silica gel; and then the adsorbent with the captured odor, coloring agents and gums is filtered out. The presence of free fatty acid can be reduced by saponifying with metallic hydroxides and removal of soap stock by centrifuge or filter. Free fatty acids can also be reduced by vaporizing the free fatty acid off the non-volatile oil under vacuum. Odor is reduced by vaporizing the free fatty acid and other volatile odor bodies, which are then removed into the vacuum system. The resulting higher-quality, pretreated natural oils are commercially identified and specified under trading rules, such as those published by organizations such as the National Institute of Oilseed Products and the American Fats and Oils Association.

Conventional splitting processes are used to chemically transform the fats, oils and greases into crude fatty acid and crude glycerin. These splitting processes include the Twichell process, batch autoclave process, continuous hydrolysis and enzymatic process. The most prevalent of these technologies is continuous hydrolysis, which can be practiced using reaction-driving catalysts, though modern systems run non-catalytically. In the hydrolysis process, natural oils and water flow counter current through a high-pressure vertical column. High temperature and the removal of the glycerin product with excess water drives the reaction forward, splitting crude fatty acid from crude glycerin, which is removed with the water. The reaction is typically 95–99% complete with minor cross contamination coupled with some unsplit oil contaminant in the crude fatty acid and glycerin streams.

The "crude fatty acid" reflects the characteristic chain-length distribution, color, and odor of the feed oil. The crude fatty acid is flash or vacuum dried to be typically 97–99% fatty acid, the balance being 1–3% unsplit oil, water and other contaminants, including trace glycerin.

The glycerin stream is concentrated to remove excess water and settled to remove some unsplit oil and crude fatty acid. This concentration of the glycerin stream generates what is generally commercially described as "crude glycerin," with 80–92% glycerin, 8–18% water and a balance of less than 2% unsplit oil and other contaminants including trace fatty acid. Crude glycerin is additionally produced during the direct saponification of natural oils into soap and glycerin, and by the trans-esterification of fats and oils into fatty esters and glycerin. With some pretreatment for salt and methanol or ethanol, the crude glycerin from the direct saponification process can be further refined with the same techniques as are used in the refining of glycerin that is split from natural oil by hydrolysis. For the purposes of this description, all sources of crude glycerin are processed according to the same methods.

The crude glycerin is further processed into commercial-grade refined glycerin. Refined glycerin is the commercial product for industrial, commercial or food-grade (United States Pharmacopoeia, USP) applications. The commercial applications for refined glycerin are wide, and include pharmaceuticals, cosmetics, explosives, personal care, tobacco and cleaning products. While there are some applications for refining glycerin that include ion-exchange technology, refined glycerin is generally processed from crude glycerin by distillation. Additional steps can include some pretreatment, such as water washing.

The basic principle of distillation is the separation of mixtures of volatile and non-volatile components. Separation occurs because the different components have different vapor pressures at constant temperature. The mixture is heated and then vaporized under vacuum, boiling off only the components that are volatile at that combination of temperature and vacuum. The non-volatile components, most contaminants, and some incompletely vaporized volatile components are extracted as "still bottoms." Still bottoms are generally a low-grade byproduct, which is either recycled or disposed of into another application. The temperature and vacuum are selected to achieve a high yield, while limited to protect the quality of the distillate. Feedstock quality is a major factor in striking this balance. The distillate vapor is condensed as a clean product in cooling sections. Some extremely volatile components and non-condensable gases, such as air that was entrained in the feed, are passed on to the vacuum system.

In the case of glycerin distillation, the crude glycerin feedstock is heated to a temperature that vaporizes the glycerin and water, leaving the unsplit oil and contaminants, along with some unvaporized glycerin loss as still bottoms. The process is operated to improve the yield of the distillate while reducing the carry over of unwanted color and odor molecules. The degree of loss of some volatile glycerin is dependent on equipment design and rate of distillation; but, generally, the yield loss is 2–5% greater than the unsplit oil and contaminant level by mass. The distilled glycerin is collected in the condensing section, with the water passing to the vacuum system. The distilled-glycerin product is suitable for many industrial and commercial applications.

Certain applications for refined glycerin require color and odor quality that exceed what can be practically delivered by distillation alone. These refined glycerin products may require further color and odor treatment. Adsorption bleaching can be performed by either a batch or continuous slurry process, where powdered activated carbon is mixed with the distilled glycerin and then removed by filtration along with the captured color and odor components. The more common process is fixed-bed bleaching where the glycerin is flowed through a reactor vessel filled with an adsorbing material, such as granular activated carbon. The resulting product is suitable for higher-quality applications such as those calling for USP glycerin.

The crude fatty acid derived from the splitting process has a chain-length distribution, a color, and an odor that are characteristic of the feedstock oil. The crude fatty acid contains some unsplit oil from the incompleteness in the splitting process, contaminants from the process or feedstock, a small amount of glycerin, and a small amount of moisture. This is generally referred to as a "crude whole-cut fatty acid." These whole-cut fatty acids will be differentiated both by the differences inherent in the feedstocks from which they were derived and/or by further processing. One way to group the main commercial fatty-acid product groups and their characteristics is into the following groups: whole-cut distilled, blended distilled, separated and fractionally distilled. Each of these groups is discussed, below.

Whole-Cut Distilled Fatty Acids:

Whole-cut distilled fatty acids are several fatty acids that are high-purity versions of their crude whole-cut intermediates, with their primary characteristics being derived from the feedstock. They can be further processed and differentiated by hydrogenation to change their degree of saturation.

A whole-cut distilled commercial product is produced by the distillation of selected crude whole-cut fatty acids. The characteristics of the crude whole-cut fatty-acid composition selected for distillation largely determines the characteristics of the finished product. The crude whole-cut fatty-acid composition includes mostly fatty acid with minor quantities of unsplit oil, water and contaminants.

Distillation is, as earlier described, the separation of ingredients based on differences in their vapor pressures at the same temperature under vacuum. The distillate that vaporizes is recovered in the condensing section as a clean refined product. Water and some highly volatile components are carried over to the vacuum system. The still-bottoms cut includes the unsplit oil, contaminants from the feed oil or picked up in the process, much of the color- and odor-containing molecules, and some volatile oil that was not vaporized.

The distillation process is operated to optimize yield of the distillate without carrying over unwanted color and odor molecules. The degree of loss of some volatile fatty acids is dependent on equipment design and rate of distillation; but, generally, the yield loss is 2–7% greater than the unsplit oil and contaminant level. Some distilled fatty acid may be additionally hydrogenated to reduce the number of unsaturated carbon atoms to both stabilize the fatty acid and to alter its characteristics, such as its melting temperature.

Distilled whole-cut fatty acids have a wide variety of applications in products such as soap, synthetic rubber, plastics, lubricants, cleaning products, recycled paper de-inking.

Blended Distilled Fatty Acids:

Combinations of whole-cut or component fatty acids can be blended to create characteristics of the mixture. This blending can be performed at various stages of the process.

Blended distilled fatty acids are merely the result of blending together whole cuts and/or fractions of whole cuts to create a product having the blended characteristics of the mixture. The reason for blending is to create characteristics unavailable from an individual natural oil. The blending can be carried out pre-process with the natural oils, with intermediates, or with finished fatty acids to achieve similar results. The process steps remain the same. The most notable application has been in the blending of long- and short-chain-length fatty acids to create desired lathering characteristics in bar soap.

Separated Fatty Acids:

Crude whole-cut fatty acids, particularly from tallow or palm oil, have mixtures of unsaturated (such as oleic, linoleic, and linolenic), and saturated (such as palmitic and stearic) chain lengths. Separated acids are those that take these crude fatty-acid feedstocks and separate the mixture into primarily unsaturated and saturated components by fractional crystallization. The separated acids are then further refined by distillation and, in the case of saturated acids, optionally by hydrogenation.

Separated fatty acids are mostly produced from crude whole-cut palm oil or tallow fatty acids because both feedstocks include significant quantities of both saturated and unsaturated chain lengths. Separation by differences in vapor pressures is impractical due to the fact that the vapor pressures of unsaturated and saturated versions of the same chain length are close. While separation can be accomplished by using means such as molecular sieves, separation is most-commonly performed by fractional crystallization. Separation is generally practiced with the aid of solvents, detergents and crystal modifiers.

The separation process is based on the wide difference between the temperatures at which saturated and unsaturated chain lengths crystallize. This temperature difference is exploited by carefully controlling the cooling of the mixture of saturated and unsaturated fatty acids. During the cooling process, the saturated fatty acid crystals form and grow while the unsaturated chains remain liquid. The crystallized saturates are then removed from the mixture by filtration. Some saturates pass through the filter, and some liquid gets trapped in the solid cake, creating some cross contamination. The saturate cake is remelted for further handling.

Both streams, although altered in their chain-length distribution, remain crude intermediates, with some evidence of the contaminants that were inherited from the crude whole-cut feed. The crude unsaturated fatty acid is further refined by distillation to make a commercial product suitable for applications in which the crude unsaturated fatty acid's low melting point and relatively high solubility are advantageous, such as for use as a liquid lubricant. The crude saturated fatty acid is further refined by distillation and usually hydrogenated to saturate the contaminant unsaturates from the separation process, converting the contaminant unsaturates into chemically equivalent saturated fatty acid. Commercial applications for the refined saturates include those applications where the high melting temperatures and the relative mildness of the saturates are advantageous, such as in solid lubricants and personal care products.

Fractionally Distilled Fatty Acids:

Crude whole-cut fatty acids, primarily from coconut and palm kernel oil, have broad chain-length distributions. Individual chain lengths have different vapor pressures at constant temperature. The relationship between the chain length and vapor pressure allows for the process of fractionation or fractional distillation to subdivide the chain lengths using targeted distillation and condensation temperatures. The bottoms cut from these operations are further refined by distillation and optionally by hydrogenation.

Fractional distillation, or fractionation, is a separation process based on the difference in vapor pressure of individual hydrocarbon chain lengths at the same temperature. Fractional distillation is widely practiced in the petroleum industry and elsewhere in the oleo chemical industry on fatty esters. Fatty acid fractionation, discussed here, is most commonly carried out on crude whole-cut coconut or palm kernel fatty acid, because of the wide distribution of carbon chain length in these fatty acids, primarily in the range of C-8 to C-18. The process concepts are also applicable to and practiced for use on separating, for example, C-20 and C-22 chain lengths. Most commonly, crude whole-cut coconut or crude palm kernel fatty acid is heated and sprayed into the lower part of a vertical vessel pulled under vacuum from its top section. The optimal temperature and vacuum condition are selected based on the targeted point of separation. The shorter chain fatty acids with higher vapor pressures boil and travel up the vessel.

The vessel design has one or more section(s) where vapors are condensed. The internal structure of the vessel creates a large contact area between single chain-length fatty acids in their liquid and vapor phases to facilitate purity of the separation, which is achievable at 99+%. The process creates a distillate top cut that vaporizes and condenses in the vessel, and an undistilled bottom cut that is drawn off. The distillate top cut may be of a single chain length, such as C-8 (with trace natural C-6), or of multiple chain lengths, such as C-8 and C-10 together; and a high purity in the top cut is achievable with trace presence of the higher-boiling-temperature C-12. In the case of a distillate of C-8 and C-10 together, the bottom cut would include the C-12 through C-18; and, noticeably, the bottom cut would also include all of the traditional still bottoms' unsplit oil and contaminants. The bottom cut is still considered a crude fatty acid because its contaminants are carried forward from the earlier splitting process. This bottom cut is henceforth referred to as "crude C-12/C-18." Trace water and non-condensable gases pass to the vacuum system.

The crude C-12/C-18 is stored for future processing via this fractionator, or the crude C-12/C-18 is directly routed through a second fractionator. In either case, this second fractionation process is similar to the initial fractionation process, described above, except this second fractionation is carried out at a higher temperature of vaporization and at a higher condensing temperature profile to fractionate off the next top cut. For example, the top cut from this second fractionation can be either single-chain-length high-purity C-12 or a combination of C-12, C-14, etc., leaving a complementary crude C-14/C-18 or crude C-16/C-18 bottom cut. The process can be repeated, taking successive single or multiple cuts off the crude undistilled bottoms cut.

Any of the bottom cuts could be fully distilled at higher temperature profiles to turn a crude undistilled bottoms cut into a refined distilled product. That would leave the traditional still bottoms containing the unsplit oils, other contaminants and some vaporizable fatty acid. E.g., crude C-12/C-18 becomes C-12/C-18 distilled.

In each of the fractionation steps, the top-cut product is a clear commercial-grade product, and the bottoms cut is a crude intermediate material that is further processed for nearly all applications. Due to the unsaturation in some C-16 and C-18 chain lengths, sometimes distilled cuts that include those chain lengths are hydrogenated to reduce unsaturation. Fractionated products are used for applications that require certain specific chain lengths or that require the removal of chains that create unwanted characteristics in the derivative or its process.

SUMMARY

Accepted industry specifications for oleo chemicals, such as fatty acids and glycerin, for particular applications typically dictate that the oleo chemical be produced utilizing a distillation step to remove at least one "bottom cut." Moreover, the chemical suppliers have established distribution channels and marketed these distilled compositions for applications calling for these oleo chemicals. The distillation step that has been utilized in previous processes, as described above, for preparing the compositions resulted in some quality improvements to the crude feedstock. These improvements include color reduction, odor reduction, removal of residual unsplit oil, removal of contaminant cross products (glycerin from the crude fatty acid and fatty acid from the crude glycerin), removal of water and removal of other contaminants (metal, dirt). The removal of these materials from the fatty acid or glycerin is highly valuable in some commercial applications. The removal of these components, however, is of little or no value to other applications. The following methods and products of this description are particularly well suited for those applications where the removal of those components is found to be less important.

Additionally, the nature of business traditionally has not been for the customer to disclose to the supplier the complete particulars of the customer's applications or for the supplier to demonstrate any proprietary internal workings of its production to the customer, particularly where this information has cost/price implications. Commercial relationships generally have been limited to customer requests for proposals from suppliers to deliver a product in accordance with customer-generated specifications, generally drawn off of industry standards. Consequently, feed materials and supply channels that pre-exist in a viable supply network for similar existing applications typically are implemented in the next use without challenging/re-evaluating the end-users' actual requirements and without redefining the supply system to optimize the value.

This method of arm's-length business is only further reinforced by internet buying. Departures from this model are rare, even when being applied to supply arrangements internal to a corporation but across budgetary and profit center boundaries. The barriers to collaboration across supplier/customer interfaces are significant. The barriers are rooted in protection of trade secrets, individual organization profit and cost responsibilities, and protection of the competitive environment. Further, these barriers preserve the status quo or limit the progress to incremental, evolutionary change.

Methods and products of this disclosure are founded, in part, on an understanding of the extended process from the availability of natural raw materials, through the customer's process, to the end user's need and from questioning the value equation, discarding accepted paradigms of thought, so as to supply the best value. The methods apply alternative technology to treat crude intermediate materials to meet real customer needs at reduced operating and maintenance cost, reduced yield loss and/or avoidance of distillation capacity capital investment cost, thereby altering the value equation to provide the best value to the customer. Many of the applications where products of these methods will find use are those where customers have for many years or decades used only distilled versions of the fatty acid, glycerin or other oleo chemical.

Methods involving the absorption-bleaching processes, described herein, produce compositions that can serve as substitutes for distilled oleo chemicals in products where medium-grade color and odor quality is required. More specifically, the process for production of semi-finished fatty acids and glycerin from crude undistilled intermediate materials produced via these methods can be used in product applications where the quality enhancement provided by distillation is not required.

These methods can enable one to achieve product quality that is sufficient to meet requirements for certain fatty acid and glycerin commercial-grade applications through the use of an adsorption bleaching process applied to crude fatty acids and crude glycerin intermediate materials. As used herein, the term, "crude," refers to a feed that includes the contaminants of its source composition, as a function of it being undistilled or as a function of being the bottom cut of any distillation that was performed. The products of adsorption bleaching of crude oleo chemicals are herein referred to as "crude-bleached" oleo chemicals.

Advantages that can be achieved with the various oleochemical product groups via the methods disclosed herein include the following:

- meeting the quality requirements for certain commercial applications for whole-cut fatty acids by adsorption bleaching the crude split whole-cut fatty acid without requiring a distillation process step;
- meeting the quality requirements for certain commercial applications for blended whole-cut fatty acids by adsorption bleaching the blend of crude split whole-cut fatty acid without requiring a distillation process step;
- meeting the quality requirements for certain commercial applications for fractionated fatty acids by adsorption bleaching the crude fractionated bottom cut fatty acid without requiring a distillation process step;
- meeting the quality requirements for certain commercial applications for separated unsaturated fatty acids by adsorption bleaching the crude unsaturated fatty acid without requiring a distillation process step;
- meeting the quality requirements for certain commercial applications for separated saturated fatty acids by adsorption bleaching the crude saturated fatty acid without requiring a distillation process step; and
- meeting the quality requirements for certain commercial applications for glycerin by adsorption bleaching the crude glycerin without requiring a distillation process step.

BRIEF DESCRIPTION OF THE DRAWINGS

In the accompanying drawings, described below, like reference characters refer to the same or similar parts throughout the different views. The drawings are not necessarily to scale, emphasis instead being placed upon illustrating particular principles of the methods and apparatus characterized in the Detailed Description.

DETAILED DESCRIPTION

Figure 1:
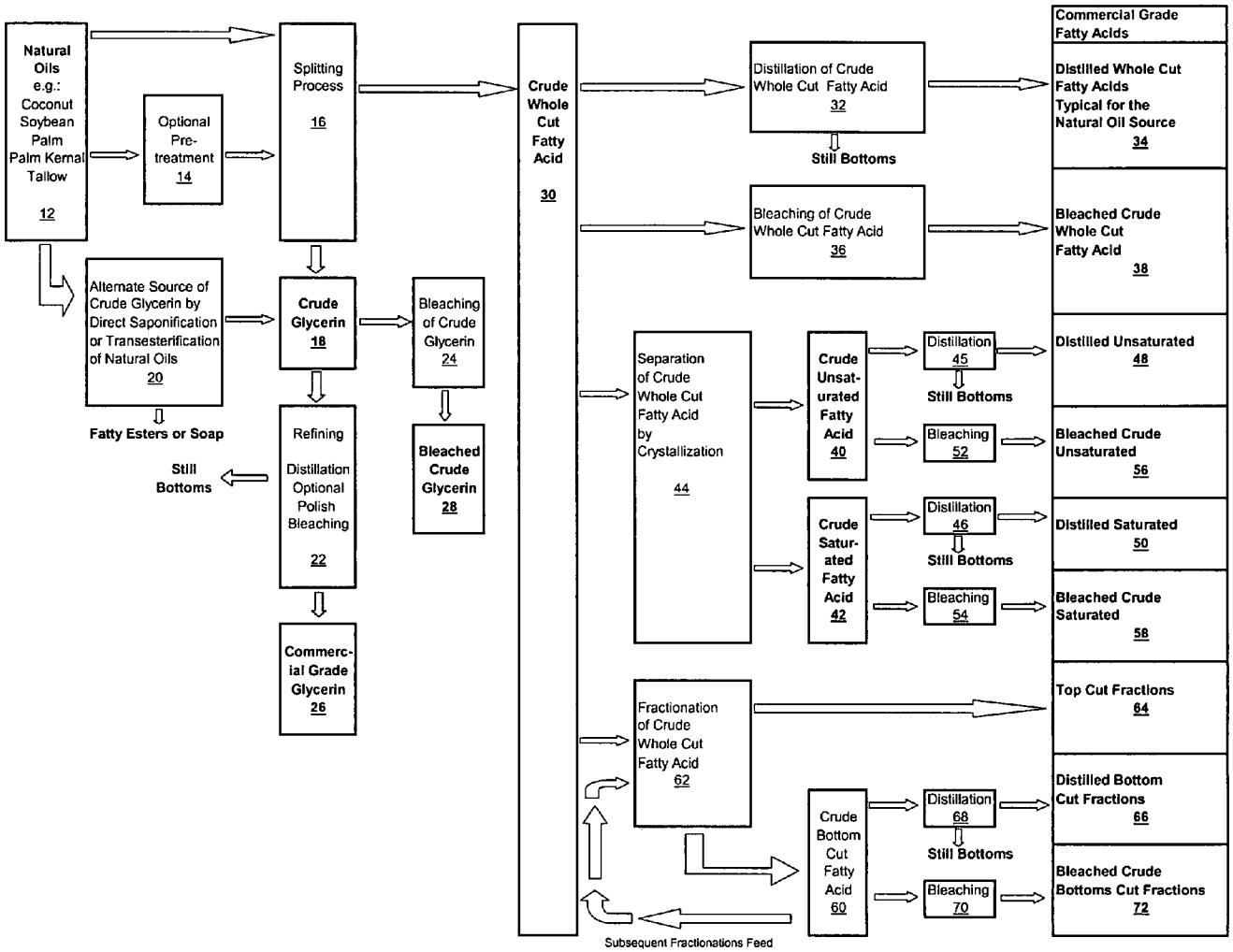
FIG. 1 is a composite flow chart of both existing processes for natural-oil splitting, separating and fractionating and the new processes utilizing crude bleaching of fatty acid and glycerin, as described herein, so as to demonstrate the degree of overlap and compatibility that makes the new processes integrate well with existing production systems.

Adsorption bleaching via application of batch, slurry, or fixed-bed procedures utilizing commonly applied adsorptive bleaching agents is substituted for distillation in processes for refining crude fatty acids, glycerin and other oleo chemicals to provide a more efficient mode for meeting the quality requirements of certain commercial applications. Importantly, these crude bleaching processes have been found to effect the improvements that are actually needed in many commercial applications, while omitting other improvements (offered by distillation) that either do not actually offer an advantage for a particular application or that do not satisfy a cost/benefit analysis for that application.

Distillation, as described in the Background section, removes contaminants from the crude material by vaporizing and then condensing what becomes the distilled product that generally goes to the commercial application with or without further processing. The non-volatile contaminants are removed as a still bottoms cut, which is recycled into another process or application. The still bottoms typically include contaminant unsplit oils, cross products from some prior unit operation, water, dirt, color- and odor-containing molecules from either the feedstock or the process. This removal of the still bottoms changes the crude material into an improved-quality distillate product. Because of imperfect separation from the still bottoms, there is an additional loss of 2–6% of potential targeted distillate into the bottoms. This loss of yield is dependent on equipment design, process rate, feedstock quality, operating technique and finished product quality targets. The costs of distillation are:

- Capital for distillation capacity: The still size, its additional process-optimization features, and its process flow rate all are factors that influence the yield and quality. In addition to the direct distillation equipment, the capital includes the utilities of steam or hot-oil boiler capacity, cooling for condensing, vacuum systems, and storage tanks for the finished product as well as for the crude feed.
- Operating and maintenance: The utilities required for this distillation include a heat source for producing the high temperature needed to vaporize the volatile component; the cooling system to condense it; steam and condensing water for steam vacuum ejectors or electricity for vacuum pumps to produce the vacuum; and electricity for pumps to move the materials. The process also utilizes skilled operators to monitor the materials, process conditions and product analyses and to make proper adjustments. The entire system requires the investment of substantial resources for maintenance of piping, pumps, tanks, heat exchangers, insulation, process safety devices, instruments and computer equipment.
- Material yield losses: Starting feedstocks may cost from about $0.13 to $0.50 per lb. or more. The material lost in still bottoms are generally 5–15% for whole-cut crude material depending on feedstock quality and the effectiveness of previous processes. Losses are upwards of 25% in the case of some fractionated fatty acid crude bottoms cuts. The generated still bottoms vary substantially in value, as they are used for applications such as animal feed and substitute fuel or as they are recycled into lower-grade products. The yield can be improved by using larger and more-efficient equipment and a slower process rate, though such changes increase capital cost.

In total, distillation costs from a few to several cents per pound of product depending on the character of the feedstock involved, the cost of utilities and whether additional distillation capital is required.

The basic batch or slurry adsorption bleaching technology has been described in the Background section, above, as it has been traditionally applied to the pretreatment of feedstock oils and has sometime been used to polish distillate for improving product quality, primarily in color enhancement. In batch or slurry bleaching, adsorption agents, such as bleaching earth, silica gel, powdered carbon, etc., are well mixed with the material to be bleached either in a batch process or in a continuous slurry process. The close interaction allows the bleaching agent to adsorb color and odor molecules. The mixture is then filtered to remove the bleaching agent with its adsorbed color and odor. The bleaching agent captures some target material as well. The contaminated bleaching agent is disposed of at cost or recycled into some low-value outlet. The finished product filtrate is improved in color and odor, but not materially affected in its other quality features, such as moisture or chemical characteristics.

In an alternative to batch or slurry adsorption bleaching, the adsorption agent (e.g., granular activated carbon) can be held in a fixed bed vessel, where the feed material is continuously pumped through the bed creating close interaction with the carbon. Pressure, vacuum, and heat may be regulated to drive or protect the process. These variables can be governed to control the flow through adsorption bed so as to establish a residence time that will effectively adsorb the desired contaminants from the process stream onto the carbon. Pressure control is exercised to ensure sufficient to pressure to overcome the pressure drop across the carbon bed, while simultaneously ensuring that the pressure does not exceed the limits of the carbon-containing vessels in which the adsorption takes place. Temperature control can be exercised to improve the adsorptive effectiveness of a specific carbon on a specific contaminant within the process stream and also to help control pressure drop across a carbon bed as a function of stream viscosity. Flow and pressure control are typically controlled by the combination of a centrifugal pump with a flow-control valve, and temperature control is typically exercised via a non-contact heat exchanger in the feed stream before the carbon adsorption. Finally, the vacuum is used at the end of the system to remove any gas released in the process.

The process can be run through one bed, in batch mode successively through the same bed, or through multiple beds in series depending on the result desired and the condition of the bleaching material. The adsorption agent in the fixed bed adsorbs color and odor from the passing feed material. Over time, the effectiveness of the granular carbon decays, and the bed is replaced. Spent carbon that has adsorbed color and odor will also have had its sites filled with both contaminant and target material. Spent carbon can be regenerated by the supplier of the carbon. The treated material is reduced in color and odor but otherwise not materially changed.

The absorptive bleaching technologies and materials of this disclosure are applied on an application-specific basis. The choice of technologies and adsorptive agents will depend on the nature of the feedstock, its contaminants and the degree to which color and odor improvement is desired to meet the specific application. The choice of treatment agent and process can be determined by a case-specific experimental process. In the first stage of the experimental process, various absorption media (e.g., carbon, clay and silica gel) are employed for bleaching the sample. The bleaching data using the various absorption media can then be evaluated to determine which media or combination of media is most effective in serving the desired process objectives. Initial qualitative lab experimentation with the subject material using different absorptive agents may produce clear differences in effectiveness of such agents as clay, activated carbon or a combination of the above. If, e.g., activated carbon is shown effective, then more quantitative isotherm testing can be conducted to determine the type of carbon to be used.

Depending on the results of the lab testing of the absorption media, the basics of a process can be decided upon. Generally, if the system is going to require the use of clay and or a combination of clay and carbon, a system design may be a batch bleaching process with a filtration step. If carbon alone is shown to be effective, a system of fixed beds with granular activated carbon may be employed. A more detailed column test can determine the most effective system configuration, be it single stage or multiple stage columns. The system design should determine the economics of the treatment to customer application-specific end points.

The collective learnings from the experiments in the Experimental Section, infra, with different adsorption agents affirms that the initial lab scale testing can be advantageous in terms of developing a highly effective treatment regimen (in terms of selection, e.g., of bleaching agent and bleaching stages) for a particular source material. Differences in feedstock have been demonstrated to be important, and the end point desired by the customer-specific application additionally contribute to effective process design.

The costs associated with adsorption bleaching technology are the capital cost of a bleaching system; the cost of system operation and maintenance, including the regeneration of spent carbon or the recycling or disposal of spent bleaching agents; and the costs associated with the loss of entrained material. The complexity of the absorption-bleaching equipment and supporting utilities is much less than that of a distillation system. The utilities, operating and maintenance effort is less than the distillation system. Spent carbon regeneration or the purchase and subsequent disposal of bleaching agent typically represents the greatest cost and is highly dependent on both the quality of the feed and the desired quality of the treated product. Yield loss of targeted product is well less than 1% in batch or slurry processing (with the small amount of loss due primarily to entrapment of a portion of the target product in the adsorption material), while yield loss of targeted product is nearly zero for most fixed bed applications. Overall, the cost of adsorption bleaching and its relation to the cost of distillation is highly application-specific, depending on feedstock, type of contaminant and degree of improvement in color necessary for the application. Bleaching does not, however, effect all of the changes that distillation accomplishes.

The adsorption bleaching is utilized to treat crude intermediate fatty acid or glycerin to make improvements in color and odor. The applications where adsorption bleaching of a crude source would be substituted for distillation are those where the additional changes that distillation effects are either not necessary or are not desired in consideration of their premium cost. A description of the overall process sequence and examples of where it would be applied to commercial applications follows.

One embodiment of such a bleaching process includes the sequence described in the following paragraphs and in the flow chart of FIG. 1, wherein a natural oil (e.g., a fat, oils, or grease) is used as the starting material.

The natural oil 12 may be pretreated 14 with bleaching technology, as described in the Background. As discussed, above, there is a reduction in the distillation cost and enhancement of product quality when the oils are pretreated, though at the cost of greater yield loss and increased energy demand. Pretreatment may be required for certain applications and may be cost justified in others. When bleaching crude feeds without distillation, the pretreatment of oils likewise reduces the cost of crude bleaching and enhances product quality. Accordingly, pretreatment remains, as in the methods of the Background, an application-specific option.

Natural oils 12 are chemically converted into crude whole-cut fatty acid 30 and crude glycerin 18 by continuous splitting 16, as described in the Background. In most cases, the process steps are the same as those of the methods described in the Background through the continuous splitting process.

Glycerin from the splitting process 16 contains the excess water used to drive the reaction. The glycerin stream is concentrated to remove excess water and settled to remove some fat, thereby generating what is generally commercially described as crude glycerin 18, with 80–92% glycerin, 8–18% water and the balance less than 2% as unsplit oil and other contaminants including trace fatty acid. The preparation of crude glycerin 18 in this method is similar to that of the methods described in the Background. The subsequent treatment of crude products from the splitting process is where the present method primarily departs from the methods described in the Background.

Crude glycerin 18, whether sourced from a saponification or transesterification process 20 or from the splitting process 16 can be subject to the same refining 22 to produce a distilled glycerin product 26. The crude glycerin's color and odor will be characteristic of the feedstock utilized. That color and odor is generally too dark for most commercial applications. The presence of water and other contaminants in the crude-glycerin composition presents problems for some applications. Previous commercial product applications utilized distilled glycerin, with or without post treatment to improve color, odor and contaminant level.

In the present method, adsorption bleaching 24 is employed on the crude glycerin 18, instead of distillation 22, to produce a crude-bleached glycerin product 28 for commercial applications that do not require the removal of the major water component or the small other contaminant level. Tests have shown that a single stage of adsorption bleaching 24 can improve the color of crude glycerin 18 from a dark opaque liquid to a clear color-stained liquid. Odor intensity is noticeably less in the bleached product. Successive bleaching stages have demonstrated the ability to improve that color to near that of water. The concentration of water, unsplit oil and other contaminants are reduced as some are captured in the bleaching agent but not eliminated.

Targeted applications for this improved crude glycerin composition 28, as produced by the crude-bleaching methods described herein, include its use in formulations where the presence of water is not a quality deterrent, such as in formulations that otherwise include water. Another application for the crude-bleached glycerin composition is where the water and contaminant levels do not, or do not sufficiently, detract from product performance to justify the premium cost of distillation. Examples of suitable applications include liquid laundry detergent formulations; personal care products that contain moisture, such as bar soap; and industrial applications where glycerin is used as a freeze-point modifier, such as anti-freeze.

The whole-cut crude fatty acid 30 that came from the splitting process 16 has a chain length distribution, color, and odor that are characteristic of the feedstock oil. The crude fatty acid 30 contains some unsplit oil from the incompleteness in the splitting process 16, contaminants from the process or feedstock, a small amount of glycerin, and a small amount of moisture. The color of crude whole-cut fatty acid 30 is too dark and sometimes the odor is too intense for most commercial applications. The presence of water and other contaminants presents problems for some applications. In the methods of the Background, commercial product applications utilized distillation 32 to produce a distilled whole-cut fatty acid 34 to provide acceptable color, odor and contaminant level.

In this crude-bleaching method, adsorption bleaching 36 is performed on the crude whole-cut fatty acid 30, instead of distillation 32, for commercial applications that do not require the removal of the minor water component or the small other contaminant level. Tests have shown that a single stage of adsorption bleaching 36 can improve the color of crude whole-cut fatty acid from a semi-opaque, dark, amber/brown liquid to a clear amber liquid. Odor intensity is noticeably less in the crude-bleached fatty-acid composition. Successive bleaching stages have demonstrated the ability to improve that color to light amber. The minor concentration of water, unsplit oil and other contaminants are marginally reduced but not eliminated, as some are captured in the bleaching agent.

Targeted applications for this improved crude fatty-acid composition 38, as produced by the crude-bleaching process 36, include those applications where a minor concentration of water does not impair product quality, such as formulations that otherwise include water. Other applications are those where the water and contaminant level do not, or do not sufficiently detract from product performance to justify the premium cost of distillation. Examples of applications include liquid laundry detergent formulation as well as applications where the crude-bleached fatty acid is neutralized with a water-based solution of metallic hydroxide, such as caustic soda, to make soap. Other applications for the crude-bleached fatty-acid composition 38 include consumer or industrial applications where the presence of minor contaminants does not present negative quality concerns. Examples include use in paper de-inking cleaners, lubricants, dark rubber or plastic applications.

The crude unsaturated and saturated fatty acids 40 and 42 that are separated 44 from crude whole-cut fatty acid 30 include some unsplit oil from the incompleteness in the splitting process 16, contaminants from the process or feedstock, a small amount of glycerin, and a small amount of moisture. The crude unsaturated and saturated fatty acids 40 and 42 are presently too dark in color and may have too intense an odor for commercial application. The crude unsaturated fatty acid 40 is especially dark as compared to the saturated fatty acid 42, largely because the unsaturated bonds are more susceptible to chemical attack including oxidation.

In the methods of the Background, commercial product applications distilled 45/46 the unsaturated/saturated fatty acids 40/42 to produce a distilled fatty acid 48/50 having acceptable color, odor and contaminant level. In the present method, adsorption bleaching 52/54 is applied to the crude separated fatty acid 40/42 from the fractional crystallization process 44, instead of distillation 45/46, for commercial applications that do not require the removal of the minor water component or the small other-contaminant level. Examples of applications for the crude-bleached unsaturated fatty acids 56 include lubricant systems that employ a water/oil mixture and industrial lubricants. Examples of applications for the crude-bleached saturated fatty acids 58 include industrial lubricant systems, such as metallic stearate greases.

Crude undistilled bottoms cuts 60 from various fractionation processes 62 (which also produce top-cut fractions 64) include fatty acids having the respective chain lengths from the fractionation processes 62, and contaminants from the crude whole-cut fatty acid 30. Contaminants include unsplit oil, moisture, and glycerin. The contaminants are ever concentrating in the bottoms cut 60 with successive removal of shorter chain lengths as top-cut distillate products 64. The color of crude fractionated bottoms cut fatty acid is too dark and sometimes the odor is too intense for most commercial applications. The presence of water and other contaminants present problems for some applications.

In previous methods, commercial product applications utilized the distillate 66 from distillation 68 of a fractionated bottoms-cut fatty acid 60 to provide acceptable color, odor and contaminant level. The present method applies adsorption bleaching 70 to the crude bottoms-cut fatty acid 60, instead of distillation 68, to produce a bleached crude bottoms-cut fraction 72 for commercial applications that do not require the removal of the minor water component or the small other-contaminant level.

Tests have shown that a single stage of adsorption bleaching can improve the color of crude bottoms cut C-12/C-18 fatty acid from a semi-opaque dark amber/brown liquid to a clear brown liquid. Odor intensity is noticeably less. Successive bleaching stages have demonstrated the ability to improve that color to clear amber. The minor concentration of water, unsplit oil and other contaminants are marginally reduced but not eliminated, as some are captured in the bleaching agent.

Targeted applications for this improved crude bottoms-cut fatty-acid composition, as produced by the crude-bleaching process include those applications where a minor concentration of water is not a quality deterrent, such as formulations that otherwise include water. Other applications are those where the water and contaminant level do not, or do not sufficiently, detract from product performance to justify the premium cost of distillation. Examples of applications include liquid laundry detergent formulations as well as applications where the topped fatty acid is neutralized with a water-based solution of metallic hydroxide, such as caustic soda, to make topped coconut soap. Other applications include consumer or industrial applications where the presence of minor contaminants does not present negative quality concerns, such as inclusion of the crude bottoms-cut fatty acid composition in industrial surfactants.

EXPERIMENTAL RESULTS

A. Initial Investigation: Use of Single Bleaching Agent

1. Introduction

Bleaching fatty acids and glycerin with adsorptive agents, such as silica gel, clay and activated carbon, is a feasible way to remove color bodies at both a small scale and at a large production scale. In fatty acids, carbon bleaching affects color slightly. The tendency is to increase the clarity, but multiple-stage bleaching does not significantly affect the color of Twin Rivers Technologies' C-12/C-18 undistilled fatty acid. Bleaching fatty acid improves initial color, but stability tests of bleached and unbleached oleic acid demonstrate that carbon bleaching does not positively affect color stability. Additional testing on crude materials from the oleic-stearic (O/S) system at Twin Rivers Technologies in Quincy, Mass. gave additional positive feedback that carbon bleaching will enhance the color and clarity of crude materials. Carbon bleaching has a dramatic positive effect on glycerin from tallow and coconut oil. Multiple-stage bleaching produces glycerin that approaches a water-white color. Carbon bleaching removes some odor from fatty acid and glycerin.

Twin Rivers Technologies looked at the effects of carbon bleaching on the following crude starting products: stearic acid, oleic acid, C-12/C-18 undistilled fatty acid, crude tallow glycerin from the hydrolyzer columns at Twin Rivers Technologies in Quincy, and crude glycerin from Philippine whole-cut coconut oil (from United Coconut Chemicals, Inc., Philippines). Crude stearic and crude oleic acids were obtained from the second stage of the oleic-stearic separation system (after splitting) to obtain a more-concentrated sample of the desired product with fewer impurities. These second-stage acids are the feed for the distillation systems at Twin Rivers Technologies. Various attempts to determine an effective bleaching method were performed. Chromatography columns of activated carbon do not work with fatty acid or glycerin because the sample does not flow through the porous membrane at the bottom of the chromatography column. Also, the product cools within the column, thereby increasing viscosity above a workable level. A second option is stirring the activated carbon into the sample and then filtering it. Several attempts with small samples revealed filter paper that separated carbon fines from the fatty acid and glycerin.

In the experiments that follow, quart samples of C-12/C-18 undistilled fatty acid, crude stearic acid, crude oleic acid, Twin Rivers Technologies' tallow crude glycerin, and United Coconut Chemicals' crude coconut whole-cut glycerin were separately mixed on a heated stir plate at 180° F. for two hours with 10 g PWA pulverized (fines) activated carbon from Calgon Carbon Corporation (Pittsburgh, Pa., USA), thereby producing a sample that has 1% carbon by weight. The samples were then filtered through Whatman #1 filter paper using a 5" Hg vacuum filtration system.

After filtering, the fatty acids and glycerin samples were placed in storage tanks, and samples from the tanks were tested.

2. Experiments a. Bleaching of Fatty Acid Samples:

The fatty acid samples were bleached with the activated carbon, and their colors were compared pre- and post-bleaching, as reported in Table 1, below.

TABLE 1

| | Crude Saturated Stearic Acid | Crude Unsaturated Oleic Acid | Crude C-12/C-18 Un-distilled Fatty Acid | Crude Whole-Cut Coconut Fatty Acid |
|---|---|---|---|---|
| Pre-bleaching color (% Transmittance, 440 nm/550 nm) | 7/39 | 1/18 | 14/65 | 38/82 |
| Post-bleaching color (% Transmittance, 440 nm/550 nm) | 25/70 | 2/27 | 29/78 | 50/87 |

In the above Table (and where elsewhere reported herein), the color measurements are performed according to the American Oil Chemists Society (AOCS) Official Test Method Td 2a-64, wherein a Spectrum 20 Photometer was used to transmit a 440-nm wavelength (measures yellow)

and a 550-nm wavelength (measures red) across a path length of 21.8 mm across the inner diameter of a cylindrical glass cuvette filled with the sample. The values indicated in the Table are the respective percentages of the light that passes through the sample at each wavelength.

Figure 2:
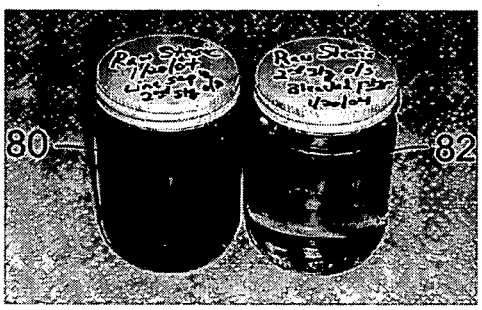
FIG. 2 is a photograph of pre-bleached and post-bleached crude saturated (stearic) fatty acid samples.
Figure 3:
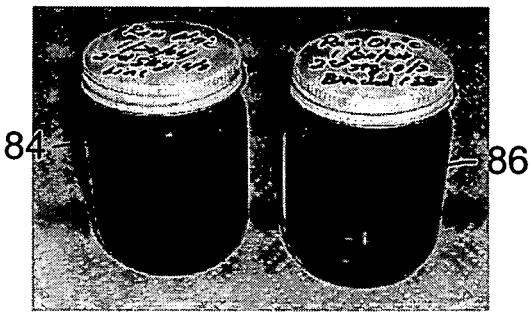
FIG. 3 is a photograph of pre-bleached crude-unsaturated (oleic) acid and post-bleached crude unsaturated (oleic) acid samples.
Figure 4:
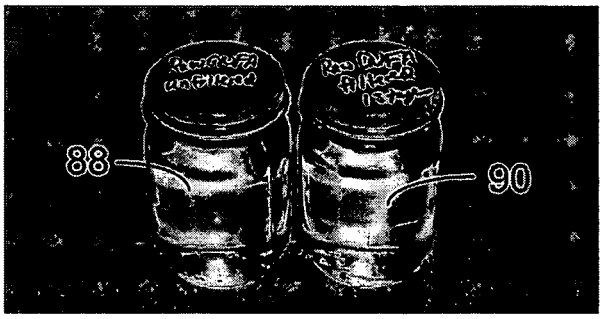
FIG. 4 is a photograph of pre-bleached crude coconut fatty acid and post-bleached crude coconut fatty acid samples.

The pre-bleached crude saturated stearic acid 80 is shown on the left and post-bleached crude saturated stearic acid 82 is shown on the right in the image of FIG. 2. The pre-bleached crude unsaturated oleic acid 84 and the post-bleached crude unsaturated oleic acid 86 are shown in the image of FIG. 3. The pre-bleached crude whole-cut coconut fatty acid 88 and the post-bleached crude whole-cut coconut fatty acid 90 are shown in the image of FIG. 4.

b. Multi-Stage Bleaching of Crude C-12/C-18 Undistilled Fatty Acid:

The color of crude C-12/C-18 undistilled fatty acid samples was tested (a) before bleaching, (b) after a first bleaching stage, and (c) after a third repetitive bleaching stage. The results of the color testing are reported in Table 2, below:

TABLE 2

| | Unbleached | Bleached Stage 1 | Bleached Stage 2 | Bleached Stage 3 |
|---|---|---|---|---|
| Color (% Transmittance, 440 nm/550 nm) | 14/65 | 29/78 | 36/80 | 42/82 |

At the end of a first bleaching stage, conducted as described above, 4 ounces of the batch was withdrawn; commencing a second bleaching stage, 10 g of Calgon activated carbon was added to the remainder of the quart, and the batch was stirred for two hours at 180° F. then vacuum filtered through a Whatman #1 filter to provides a second stage of bleaching before again withdrawing a 4-ounce sample. This same procedure was again repeated to provide a third stage of bleaching. The 4-ounce samples that were withdrawn from the batch after the first, second, and third stage were tested for color, with the results posted in Table 2, above.

Figure 5:
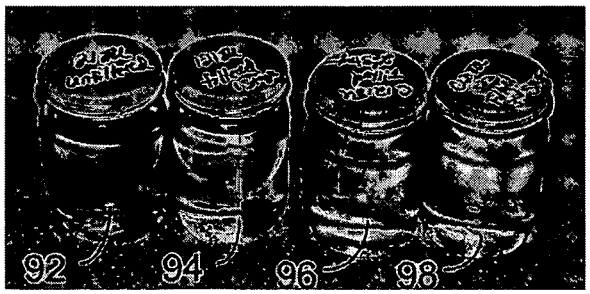
FIG. 5 is a photograph of crude undistilled C-12/C-18 fatty acid samples in an unbleached state and after successive bleaching stages.

As the C-12/C-18 undistilled fatty acid batch was repeatedly bleached, the color became lighter, though the sample retained a yellow amber color throughout the stages. The odor of the C-12/C-18 undistilled fatty acid became less pungent and stinging after bleaching, although the carbon did not completely eliminate the odor. The C-12/C-18 undistilled fatty acid samples are shown in FIG. 5 (from left to right) in the unbleached state 92, after the first bleaching stage 94, after the second bleaching stage 96, and after the third bleaching stage 98.

The breakdown of the chain lengths in the C-12/C-18 undistilled fatty acid samples is provided in Table 3, below.

TABLE 3

| | C-12/C-18 Undistilled, Unbleached Fatty Acid -- Composition (%) | C-12/C-18 Undistilled, Bleached Fatty Acid -- Composition (%) |
|---|---|---|
| C10 | 0.39 | 0.36 |
| C12 | 55.35 | 55.00 |
| C14 | 21.51 | 21.58 |
| C16 | 10.77 | 10.98 |
| C18 | 2.87 | 2.95 |
| C18:1 | 8.13 | 8.16 |
| Unsplit Oil | 0.98 | 0.96 |

In Table 3, above, the chain-length composition of the samples is determined by gas chromatograph (AOCS Method Ce 1-62). "C18" refers to a saturated carbon-18 chain length, and "C18:1" refers to a carbon-18 chain length having one unsaturated bond. The results in Table 3, above, show that the carbon treatment did not measurably alter the chemical composition.

c. Multi-Stage Bleaching of Glycerin:

For multiple-stage bleaching of glycerin (both for the Twin Rivers Technologies' tallow crude glycerin and for the United Coconut Chemicals' crude coconut whole-cut glycerin), the same procedure as that described above for the multi-stage bleaching of the C-12/C-18 batch was followed. At the end of each bleaching stage, a sample was withdrawn; to start the next bleaching stage, 10 g of activated carbon was then added to the remainder, stirred for two hours at 180° F., and then vacuum filtered before again withdrawing a sample.

The results of color and other measurements for the Twin Rivers Technologies' tallow glycerin samples taken before bleaching and after successive bleaching stages are provided in Table 4, below.

TABLE 4

| | Unbleached | Bleached Stage 1 | Bleached Stage 2 | Bleached Stage 3 |
|---|---|---|---|---|
| Color (% Transmittance, 440 nm/550 nm) | 2/31 | 45/77 | 90/96 | 97/98 |
| % Glycerin | 87.8 | 90.6 | — | 86.9 |
| Density (g/cm$^3$) | 1.23 | 1.24 | — | 1.23 |
| Fat Content | 1.6 | 0.8 | — | 0.9 |

Figure 6:
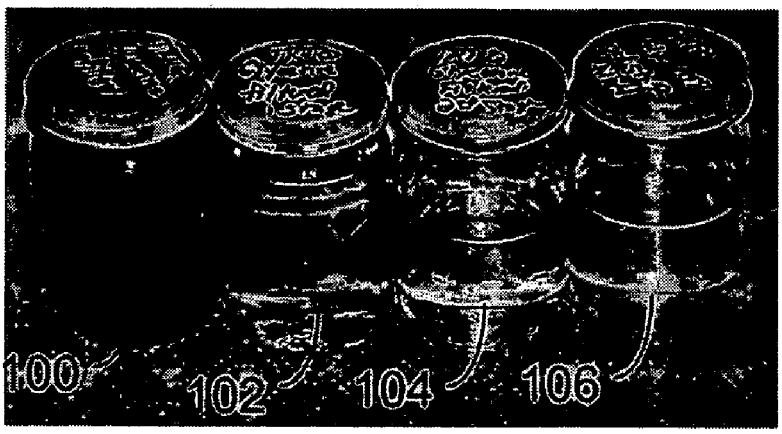
FIG. 6 is a photograph of crude tallow glycerin samples in an unbleached state and after successive bleaching stages.

The "fat content," reported above and in Table 5, is a measure of the number of pounds of 100% NaOH caustic soda required to neutralize the fat in 1,000 pounds of crude glycerin. A measurement of 1.0 minimum caustic (for complete fat neutralization) is equivalent to 0.65% fat in the glycerin. These tallow crude glycerin samples are shown in FIG. 6 (from left to right) in the unbleached state 100, after the first bleaching stage 102, after the second bleaching stage 104, and after the third bleaching stage 106.

The results of color and other measurements for the United Coconut Chemicals' crude coconut glycerin samples taken before bleaching and after successive bleaching stages are provided in Table 5, below.

TABLE 5

| | Un-bleached | Bleached Stage 1 | Bleached Stage 2 | Bleached Stage 3 | Bleached Stage 4 |
|---|---|---|---|---|---|
| Color (% Transmittance, 440 nm/550 nm) | Opaque/ Black | Translucent Black | 15/52 | 50/82 | 67/86 |
| % Glycerin | 90.2 | 89.2 | — | — | 88.4 |
| Density (g/cm$^3$) | 1.24 | 1.23 | — | — | 1.23 |
| Fat Content | 1.9 | 1.1 | — | — | 0.3 |

Figure 7:
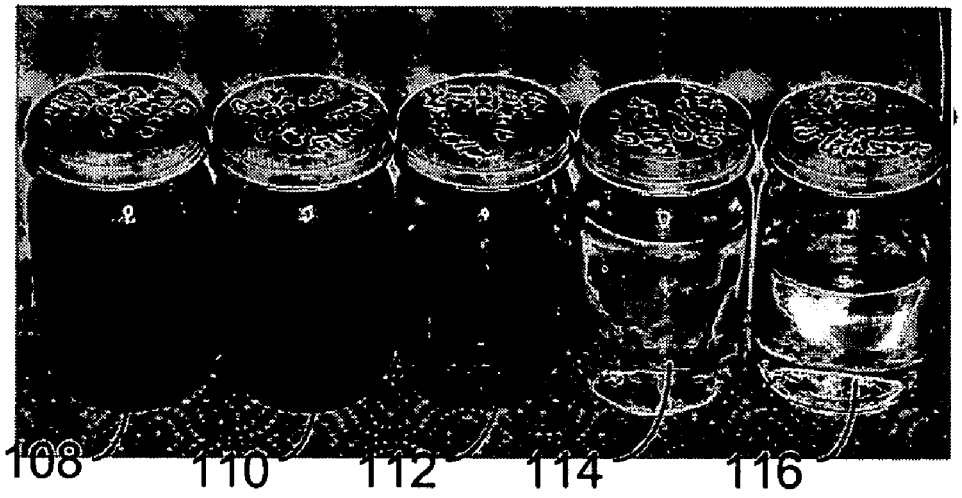
FIG. 7 is a photograph of crude-coconut glycerin samples in an unbleached state and after successive bleaching stages.

These crude-coconut glycerin samples are shown in FIG. 7 (from left to right) in the unbleached state 108, after the first bleaching stage 110, after the second bleaching stage 112, after the third bleaching stage 114, and after the fourth bleaching stage 116.

The color of both the Twin Rivers Technologies' and the United Coconut Chemicals glycerin samples improved significantly and with enough stages of carbon bleaching, a transparent glycerin can be obtained. Odor of all glycerin samples decreased slightly, but each retained a scent indicative of its source (tallow or coconut oil).

3. Discussion of Results

Carbon bleaching of crude undistilled fatty acids has been shown to have an effect on the color and odor and to not materially change the chemical composition.

Color was improved with both single- and multi-stage bleaching. The color, although lightened, retained the characteristic hue from the source oil. In practice, the degree of improvement that is necessary and thus the final selection of process parameters (e.g., the type of activated carbon, the number of bleaching stages, the duration of contact in each stage, and temperature) will be application-specific.

Odor intensity was lessened by the bleaching process, but the characteristic note of the odor was retained.

The bleaching carbon adsorption sites are occupied by only a very minor amount of the treated fatty acid; consequently, the chemical composition of the fatty acid does not change significantly. In the tests, the chain-length distribution remained materially the same, and the level of contaminant glycerin, unsplit oil and water also remained materially the same.

Glycerin responded well to carbon treatment. The activated carbon removed neutrally charged color bodies and some free fatty acids from the polar glycerin molecule resulting in clean glycerin and a lower minimum caustic. This treatment removed some odor bodies, but enough remain to determine the type of glycerin (tallow or coconut oil). However, until distillation the glycerin will always retain some water, odor, and free fatty acids.

B. Secondary Investigation: Use of Single and Plural Bleaching Agent(s) in Application-Specific Process Design 1. Introduction In furtherance of orderly individual application-specific process design, additional tests were conducted to explore the range of preferred process capability as related to the raw materials and the process selection. Twin Rivers contracted for some fixed-bed granular activated carbon testing on known extremely dark crude glycerin source material from Malaysia. The source material was crude glycerin from splitting of multiple raw crude palm, crude palm kernel, and crude coconut oils. The test demonstrated that the contaminants in the crude glycerin deactivated the fixed bed of activated carbon, when used alone, at rates that were economically unattractive.

The experiments reported below were performed using PWA pulverized activated carbon from Calgon Carbon Corporation (Pittsburgh, Pa., USA) and using AOCS official bleaching clay. The tests were performed at 120° to 125° F., and a Whatman #1 filter was used with the bleaching agent(s).

2. Experiments a. Control:

As a control, the above-described dark crude-glycerin source material was passed through the filter without bleaching. As shown in Table 6, the source material remained opaque to light at 440 nm and nearly opaque to light at 550 nm after filtration.

TABLE 6

| | Crude Glycerin | Filter paper no bleach |
|---|---|---|
| % Transmittance (440 nm/550 nm) | 0/2 | 0/4 |

b. Repetitive Stages of 1% Carbon by Weight:

Control lab tests were conducted on the above-described dark source material utilizing the same dosage rates of carbon as were used in the Twin Rivers tallow glycerin and United Coconut Chemicals crude glycerin (see Tables 4 and 5, above). The results revealed improvement from essentially 0% transmittance at 440 nm to 60% after 4 stages (see Table 7).

TABLE 7

| | Crude Glycerin | Stage 1 | Stage 2 | Stage 3 | Stage 4 | Stage 5 |
|---|---|---|---|---|---|---|
| % Transmittance (440 nm/550 nm) | 0/2 | 15/41 | 40/69 | 55/74 | 60/76 | 58/71 |

Although the repetitive steps of 1% carbon bleaching, brought this source material to a mid-range color (after stage 3), these results were inferior to the 67% transmittance at 440 nm that was obtained with carbon bleaching of the United Coconut Chemicals material (see Table 5, above). Accordingly, this source material demonstrated that it was more resistant to improvement with carbon.

c. 5% Bleaching Clay by Weight, Followed by 1% Carbon:

Further lab scale tests altered the adsorption agent and dosage levels to employ combinations of bleaching clay and carbon. The bleaching clay effectively treats different forms of crude material contaminant than the carbon does. A two pass batch system employing an initial less expensive stage of 5% clay by weight and a follow-up stage with a dosage of 1% carbon by weight effectively improved this same dark crude-glycerin source material from a transmittance of 0% at 440 nm to 62% at 440 nm, as shown in Table 8, below. This result compares favorably to the improvement accomplished with multiple stages of 1% carbon alone (see Table 7, above). An additional second stage of 1% carbon improved the color to an exceptional 85% transmittance at 440 nm.

TABLE 8

| | Crude Glycerin | Stage 1 (Clay) | Stage 2 (Carbon) | Stage 3 (Carbon) | Stage 4 (Carbon) |
|---|---|---|---|---|---|
| % Transmittance (440 nm/550 nm) | 0/2 | 14/55 | 62/82 | 85/93 | 87/93 |

Additional carbon bleaching after stage 3, appeared to have limited effect.

d. Repetitive Stages of 5% Bleaching Clay by Weight:

For comparison, the same dark crude-glycerin source material was bleached with two stages of 5% bleaching clay, alone, without the subsequent bleaching via activated carbon. As shown in Table 9, the transmittance at 440 nm remained relatively low after the two stages of clay bleaching.

TABLE 9

| | Crude Glycerin | Stage 1 | Stage 2 |
|---|---|---|---|
| % Transmittance (440 nm/550 nm) | 0/2 | 38/77 | 32/80 |

Consequently, bleaching with clay alone in this experiment appears to have removed some impurities, though its effects were limited.

e. Repetitive Stages of 5% Carbon by Weight

For additional comparison, the same dark crude-glycerin source material was bleached with two stages of 5% activated carbon (higher than in the previous tests). As shown in Table 10, multi-stage bleaching using this higher concentration of carbon produced superior results in terms of the transmittance through the bleached product.

TABLE 10

| | Crude Glycerin | Stage 1 | Stage 2 | Stage 3 |
|---|---|---|---|---|
| % Transmittance (440 nm/550 nm) | 0/2 | 74/86 | 90/96 | 96/97 |

The bleached product had a water white color after three steps.

f. 5% Bleaching Clay by Weight, Followed by 5% Carbon by Weight:

The same dark crude-glycerin source material was bleached with a stage of 5% clay and then with a stage of 5% carbon. The results are shown in Table 11.

TABLE 11

| | Crude Glycerin | Stage 1 (Clay) | Stage 2 (Carbon) |
|---|---|---|---|
| % Transmittance (440 nm/550 nm) | 0/2 | 8/47 | 82/90 |

The results from the second stage are superior to the results reported in Table 8, above, where the dark crude-glycerin source material was bleached using a lower (i.e., 1%) carbon concentration.

g. Single-Stage Bleaching of Crude Glycerin Using 5% Bleaching Clay by Weight and 1% Carbon by Weight:

With the significant improvement in the color (transmittance) of the dark glycerin after one stage of 5% clay followed by one stage of 1% carbon, this follow-up test was conducted to investigate the impact of combining these two stages into a single stage.

Specifically, the same dark crude-glycerin source material was subject to a single stage of bleaching in a slurry of 5% clay and 1% carbon. Consequently, the dosing of clay and carbon is the same as that for the tests reported in Table 8, above. The results are shown in Table 12.

TABLE 12

| | Crude Glycerin | Stage 1 (Clay + Carbon) |
|---|---|---|
| % Transmittance (440 nm/550 nm) | 0/2 | 20/58 |

With this simultaneous bleaching process, color modestly improved from 0% transmittance at 440 nm to 20% transmittance at 440 nm. These results are inferior to those reported in Table 8, where separate stages of clay bleaching and carbon bleaching improved the color to 62% transmittance at 440 nm. It is suspected that that clay and carbon interfere with each other's adsorption sites when the two media are used together.

h. Single-Stage Bleaching of Crude Fatty Acid Using 5% Bleaching Clay by Weight and 1% Carbon by Weight:

In this test, the source material was crude coconut fatty acid rather than the crude glycerin source tested in the previous examples, though the test was otherwise similar to that in the previous example. This test was performed to evaluate whether the addition of clay to the coconut fatty acid impacts the results previously attained where the crude coconut fatty acid was bleached with 1% carbon, alone (see Table 1). In the previous 1% carbon single-stage test, the coconut fatty acid 88 of FIG. 4, which had a color of 38% transmittance at 440 nm was bleached to generate a product having 50% transmittance at 440 nm.

The data from this new test are presented in Table 13, wherein "CNFA" is split undistilled coconut fatty acid.

TABLE 13

| | Crude CNFA | Stage 1 (Clay + Carbon) |
|---|---|---|
| % Transmittance (440 nm/550 nm) | 43/85 | 71/94 |

With the addition of 5% clay and 1% carbon to the raw coconut fatty acid to a raw coconut fatty acid having a starting transmittance of 43% at 440 nm, the combined bleaching improved the color to 71% transmittance at 440 nm. This result comfortably meets the customer specification for distilled whole-cut coconut fatty acid in some major base soap making applications. The clay adds the capability of treating additional components of the color of the crude coconut fatty acid beyond those effectively treated by the carbon.

3. Discussion of Results

The data, above, indicates that for this dark, Malaysian-sourced, crude glycerin sample, carbon, when used alone, needed to be charged heavily to achieve desired results. Further, the use of bleaching earth, alone, cleaned the sample, but repetition appeared to have limited effect on color. Further still, the combination of using clay and then carbon facilitated bleaching of the crude-glycerin sample.

The use of combined bleaching clay and carbon in single-stage glycerin bleaching did not achieve the same results as the clay and carbon achieve when the clay and carbon were dosed separately. However, the combination of clay and carbon in single-stage bleaching of coconut fatty acid were shown to achieve significantly better results than carbon alone.

There are several permutations of options in bleaching resulting from differing adsorption agents, at different dosages, and potentially in combined cycles. All of the various data results reinforce the value of lab testing of adsorption agents and orders of addition as a step in selecting the process for treating different starting crude materials to reach customer-specific end points.

Collectively the data confirm that color and odor improvement can be achieved by bleaching crude fatty acids and glycerin. The improvements can be made to meet many industrial and commercial applications that presently utilize distilled fatty acids and glycerin. The bleaching does not alter some other chemical characteristics that distillation achieves. In application-specific challenges, one can identify which of those characteristics are critical to the customer application and then evaluate whether a specification that delivers higher value to the customer for this application can be achieved.

In describing embodiments of the invention, specific terminology is used for the sake of clarity. For purposes of description, each specific term is intended to at least include all technical and functional equivalents that operate in a similar manner to accomplish a similar purpose. E.g., adsorptive bleaching is intended to include the application-specific choices of using various adsorptive agents such as clay, silica gel, carbon in batch, slurry or fixed bed processes. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Moreover, while this invention has been shown and described with references to particular embodiments thereof, those skilled in the art will understand that various other changes in form and details may be made therein without departing from the scope of the invention.

What is claimed is:

1. A method for improving the color and odor quality of a crude oleo-chemical composition, the method comprising adsorption bleaching a crude oleo-chemical composition, wherein the crude oleo-chemical composition comprises glycerin and is not a distillate from an earlier distillation.

2. The method of claim 1, further comprising including the oleo-chemical composition after adsorption bleaching in a commercial product; wherein, if the oleo-chemical composition is distilled, a bottom cut of the distillation is included in the commercial product.

3. The method of claim 1, wherein most of the crude oleo-chemical composition is glycerin.

4. The method of claim 3, wherein the oleo-chemical composition is 75–95% glycerin.

5. The method of claim 4, wherein the oleo-chemical composition further comprises 5–25% water and trace fatty acid.

6. The method of claim 3, further comprising deriving the crude oleo-chemical composition via a transesterification, saponification, or continuous-batch hydrolysis process.

7. The method of claim 1, wherein the crude-oleo-chemical composition is bleached using activated carbon.

8. The method of claim 1, wherein the crude-oleo-chemical composition is bleached using at least two bleaching agents.

9. The method of claim 8, wherein the bleaching agents include clay and activated carbon.

10. The method of claim 9, wherein the crude-oleo-chemical composition is bleached with clay in a first stage and then bleached with activated carbon in a second stage.

11. The method of claim 1, wherein, if the oleo-chemical composition is distilled, the bleaching is conducted on a bottom cut of the distillation.

* * * * *